US012553211B2

(12) United States Patent
Wei et al.

(10) Patent No.: US 12,553,211 B2
(45) Date of Patent: Feb. 17, 2026

(54) SYSTEM FOR MITIGATION OF UNINTENTIONAL WORKING MACHINE MOVEMENT

(71) Applicant: Caterpillar Inc., Peoria, IL (US)

(72) Inventors: Mo Wei, Dunlap, IL (US); Benjamin J. Hodel, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 268 days.

(21) Appl. No.: 17/830,129

(22) Filed: Jun. 1, 2022

(65) Prior Publication Data

US 2023/0392346 A1 Dec. 7, 2023

(51) Int. Cl.
*E02F 3/43* (2006.01)
*E02F 9/26* (2006.01)

(52) U.S. Cl.
CPC ..... *E02F 3/437* (2013.01); *E02F 9/262* (2013.01); *E02F 9/265* (2013.01)

(58) Field of Classification Search
CPC . E02F 3/437; E02F 9/265; E02F 9/262; E02F 9/205
USPC ..... 701/50
See application file for complete search history.

(56) References Cited

U.S. PATENT DOCUMENTS 3,643,828 A * 2/1972 Elliott ..... F15B 21/08 414/701
5,501,570 A * 3/1996 Mozingo ..... E02F 3/432 74/471 XY
7,756,622 B2 7/2010 Gianoglio et al.
8,977,440 B2 3/2015 Trombley et al.
11,035,389 B2 6/2021 Yuan et al.
11,242,666 B2 * 2/2022 Okada ..... E02F 9/262
2018/0230671 A1 * 8/2018 Wu ..... E02F 3/437
2018/0281849 A1 * 10/2018 Irie ..... B62D 6/008
2020/0172087 A1 * 6/2020 Shur ..... E02F 9/2025
2020/0399867 A1 * 12/2020 Daimon ..... E02F 9/262
2022/0251802 A1 * 8/2022 Konda ..... E02F 9/265

FOREIGN PATENT DOCUMENTS

DE 10063101 4/2003
DE 102006050126 5/2008
JP 2018142123 A 9/2018
JP 2018179519 A * 11/2018
KR 19990043610 A 6/1999
KR 20090034618 A 4/2009
KR 20130068544 A * 6/2013
KR 20150041936 A 4/2015
WO 2008135039 11/2008
WO 2017061911 4/2017

OTHER PUBLICATIONS

Written Opinion and International Search Report for Int'l. Patent Appln. No. PCT/US2023/021963, mailed Aug. 30, 2023 (10 pgs).

* cited by examiner

*Primary Examiner* — Isaac G Smith

(57) ABSTRACT

An apparatus can include sensor circuitry to detect a machine movement of a work machine along a surface. The apparatus can also include processing circuitry to receive machine movement information or force-related information and to determine probability that unwanted movement will occur. The processing circuitry can also provide a mitigation control signal to mitigate unwanted movement responsive to determining that the probability that unwanted movement will occur is above a threshold.

6 Claims, 3 Drawing Sheets

SYSTEM FOR MITIGATION OF UNINTENTIONAL WORKING MACHINE MOVEMENT

TECHNICAL FIELD

This disclosure relates to construction equipment, and more specifically to a system and method for mitigation of unintentional movement of construction equipment.

BACKGROUND

Working machines may make unintentional movements during working operations. For example, in the case of an excavator, the working machine may be unintentionally dragged forward during a digging operation due to the reaction force of digging, slippage on muddy surfaces, or other causes. Unintended movement can cause mis-cutting, mis-dumping and reduced efficiency, particularly when a human operator is not available in or near the working machine to make adjustments. Therefore, there is a general need for a system to reduce instances or amount of unintentional movement, and to compensate for unintentional movement when such movement occurs.

U.S. Pat. No. 7,756,622 discusses attenuating movement in construction vehicles using methods that can be adapted to changing situations of the construction machine.

SUMMARY OF THE INVENTION

In an example according to the present disclosure, an apparatus comprises sensor circuitry to detect a machine movement of a work machine along a surface or potential of machine movement; and processing circuitry coupled to the sensor circuitry to receive machine movement information and configured to: determine probability that unwanted movement will occur; and provide a mitigation control signal to mitigate unwanted movement responsive to determining that the probability that unwanted movement will occur is above a threshold.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
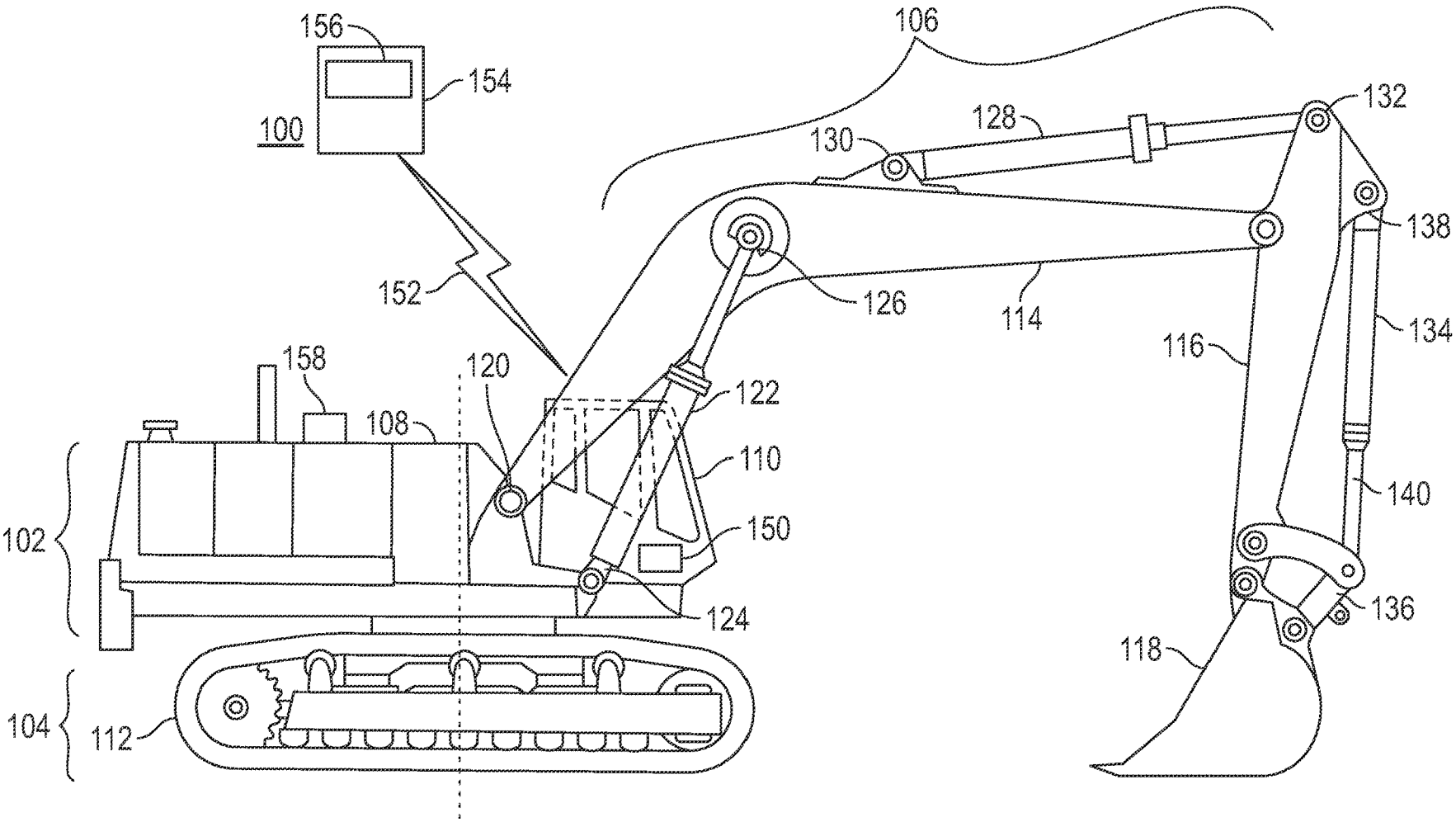
FIG. 1 shows a side view of an excavator, in accordance with this disclosure.

FIG. 1 shows a side view of an excavator 100, in accordance with this disclosure. While example embodiments are described with reference to an excavator 100, examples according to this disclosure are applicable to a variety of types of work machines in which buckets or booms attached to the work machine can cause unintended movement through digging or swinging, or in which tracks or wheels can inadvertently slip on a surface during work.

Referring to FIG. 1, an excavator 100 may include an upper structure 102, a lower structure 104 and a working element 106. The upper structure 102 may include a body 108 and an operator cab 110. The operator cab 110 is mounted on the body 108. The operator cab 110 may include devices that receive input from a machine operator which may indicate a desired maneuvering of the excavator 100. Specifically, the operator cab 110 may include one or more operator interface devices. Examples of operator interface devices include, but are not limited to, a joystick, a travel control lever, and/or a pedal (none of which are shown but are well known in the industry).

The lower structure 104 may comprise a pair of tracks 112 (e.g., transportation device), to drive the excavator 100 on a path. The pair of tracks 112 may be driven by a hydrostatic transmission or by electric travel motors which, in turn, are powered by a prime mover such as an internal combustion engine (not shown).

The working element 106 includes a boom 114, an arm (e.g., "stick") 116, and a work tool 118. The work tool 118 can comprise, for example, a bucket. The boom 114 may be mounted on the body 108 at a pivot point 120. The boom 114 is made to vertically pivot by means of a boom hydraulic cylinder 122. A first end 124 of the boom hydraulic cylinder 122 may be coupled to the body 108. A second end 126 of the boom hydraulic cylinder 122 may be coupled to the boom 114. The boom 114 may be coupled to the stick 116.

The stick 116 is moved with respect to the boom 114 by extending or retracting an arm hydraulic cylinder 128. A first end 130 of the arm hydraulic cylinder 128 is coupled to the boom 114. A second end 132 of the arm hydraulic cylinder 128 is coupled to the stick 116. The stick 116 may further be coupled to the work tool 118.

The work tool 118 is moved with respect to the stick 116 by extending or retracting a work tool hydraulic cylinder 134. The work tool hydraulic cylinder 134 moves the work tool 118 via a bucket linkage assembly 136. A first end 138 of the work tool hydraulic cylinder 134 may be coupled to the stick 116. A second end 140 of the work tool hydraulic cylinder 134 is coupled to the bucket linkage assembly 136, In an embodiment, the bucket linkage assembly 136 may be referred as a work tool linkage assembly and may be used to couple any type of work tool.

Numerous different work tools 118 may be attached to the excavator 100 and may be controlled by the machine operator. Work tool 118 may include any device used to perform a particular task, such as a blade, a fork arrangement, a bucket (shown in FIG. 1), a shovel, a cutting device, a grasping device, and/or any other task-performing device known in the art.

A controller 150 can be provided for electrically controlling various aspects of the work machine 100 including controlling movements to prevent or adjust for unintentional work machine 100 movement. For example, the controller 150 can send and receive signals from various components of the work machine 100 during the operation of the work machine 100. The controller 150 can include onboard memory or memory in a remote location can be accessed. For example, the work machine 100 and controller 150 thereof can be wirelessly communicatively, connected using connection 152 to remote apparatus 154, which can include memory 156.

The work machine 100 can include sensor circuitry to detect a translation or rotation movement, or horizontal machine movement, of a work machine along a surface, or rolling, pitching, or yawing movement. For example, the work machine 100 may include a location sensor 158 connected at one or more locations. The location sensor 158 may be capable of determining a location of the work machine 100 and may include and/or comprise a component of a global positioning system (GPS). For example, the location sensor 1:58 may comprise a GPS receiver, or other such device, and the location sensor 158 may be in communication with one or more GPS satellites to determine a location of the work machine 100 continuously, substantially continuously, or at various time intervals. Processing circuitry (e.g., controller 150) can be coupled to this sensor circuitry to receive machine movement information for control using software in some implementations, although embodiments are not limited thereto. Sensor circuitry can also include cameras, including cameras with visual odometry tracking, ranging sensors, or other sensors.

Horizontal movement can include fore-aft and side-to-side movement. Additionally, other movement such as roll, pitch or yaw can be detected. For example, unexpected roll can negatively affect the digging. Therefore, if roll above a threshold is detected, track movement compensation can be undertaken by, for example, performing alternating counter-rotations of the tracks to settle the ground. Pitch changes above a threshold can degrade the optimal breakout forces during the dig and can be handled similarly to roll, Yaw movements can typically be compensated or handled by an offset in the dig trajectory planner, and typically will not trigger other compensation or mitigation as described herein. Therefore, processing circuitry 150 can detect that the work machine has moved beyond a linear or angular displacement allowed by a threshold boundary from a work location.

During work, e.g., digging, the work machine 100 can move unintentionally. This movement is more likely to occur during autonomous work when an operator is not present to prevent extraneous movement, but unintentional or unwanted movement can occur even when an operator is present. For example, the work machine 100 can be dragged towards a work tool 118 (e.g., bucket) with or without track 112 movement during autonomous digging. This dragging or other unintentional movement can be caused by a strong reaction force from digging, or by presence of slippery or sloped ground around the work machine 100. Unintentional movement can cause mis-cutting/mis-dumping and low efficiency due to digging at non-ideal angles. Further, unintended work machine 100 movement can result in relentless empty digging in which the work machine 100 cannot reach termination conditions based on bucket location. For example, the bucket or other work tool 118 may not be able to move to a termination location due to unwanted movement. A termination location can be defined, for example, as bringing the bucket pose to a sufficient depth vertically, sufficient range horizontally (in front of the cab), or sufficient angle of cab yaw to fully excavate the desired volume of material to complete the trench, foundation, etc.

To address these and other concerns, systems, apparatuses and methods according to some embodiments can provide controlled movements to prevent or adjust for unintentional work machine 100 movement.

Figure 2:
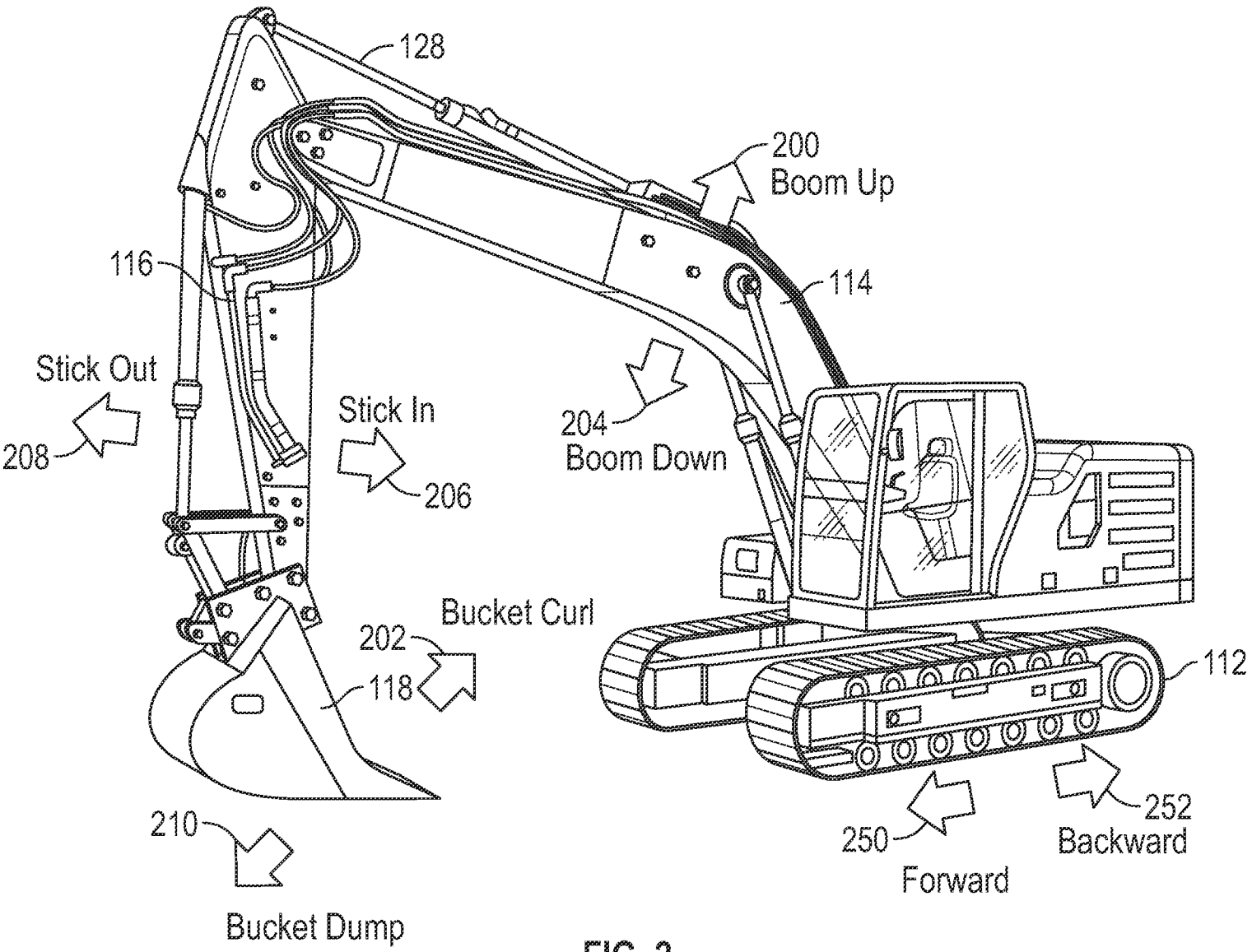
FIG. 2 illustrates movements for compensation of unwanted track movement in accordance with this disclosure.

FIG. 2 illustrates movements for mitigation and compensation of unwanted track 112 movement (and overall work machine 100 movement) in accordance with this disclosure. Compensation operations can be performed at a time determined by the operator or machine customer, such as at a swing-back period after dumping and before returning to a position for the next dig cycle. The unwanted movements are detected based on reaction force from the bucket 118, track 112 movement distance, work machine 100 movement distance, track 112 moving speed, work machine 100 moving speed, and other parameters. The movement distance and speed can be provided by, for example, an inertial measurement unit (MU), GPS 158, or another sensor or device.

Mitigation can include lifting the boom 114 (e.g., operation 200). To mitigate movement during digging, the bucket 118 can be dumped (e.g., dumped outwards, in operation 210), which reduces horizontal dirt interaction that reduces reaction force. Reaction force can be defined as follows: when the work machine 100 is digging, the stick 116 is rotated toward the machine and the bucket is curled in operation 202 resulting in a reaction force from the dirt/material in the opposite direction, that is, outward horizontally from the work machine 100 and downwards against the curling direction of the bucket 118. Other mitigation movements can include stick out operation 208.

If the work machine 100 exhibits unwanted movement outside a threshold amount (whether despite mitigation movements or before any mitigation movements are attempted), compensation movements can be performed. For example, compensation movements can be undertaken when unwanted movement has moved the work machine 100 outside an area in which work is to be performed or away from the original work machine 100 location before unwanted movement, as indicated by an MU, GPS, etc. In addition to mitigation movements described above, compensation movements can include moving tracks forward or backward in operations 250, 252, respectively. The tracks 112 can also be moved to move the entire work machine 100; for example, the work machine 100 can be moved backwards in the event the work machine 100 was inadvertently moved forward by slopes, slippery surface, or bucket 118 movement. Other movements can include boom down operation 204 and stick in operation 206.

Processing circuitry (e.g., controller 150, remote device 154 (FIG. 1)) can compensate for misaligned pose of the work machine 100 to bring the work machine 100 back to alignment of the desired pose (wherein "pose" can be understood as the machine translation and orientation in world space). In some examples, the movement compensation actions take place during the swing back phase after dumping but before the next digging. However, actions can be controlled to occur at different points in other phases of work machine 100 operations. Other phases can include, for example, after the dump, when the bucket 118 is held stationary after the dig, when the bucket 118 is lifted out of the pit but held stationary. However, movement when the bucket 118 is in the pit will not typically be undertaken in most aspects, due to uncontrollable forces on the linkage that could result. Compensation and mitigation actions can include other movements, or a combination of the above movements.

Figure 3:
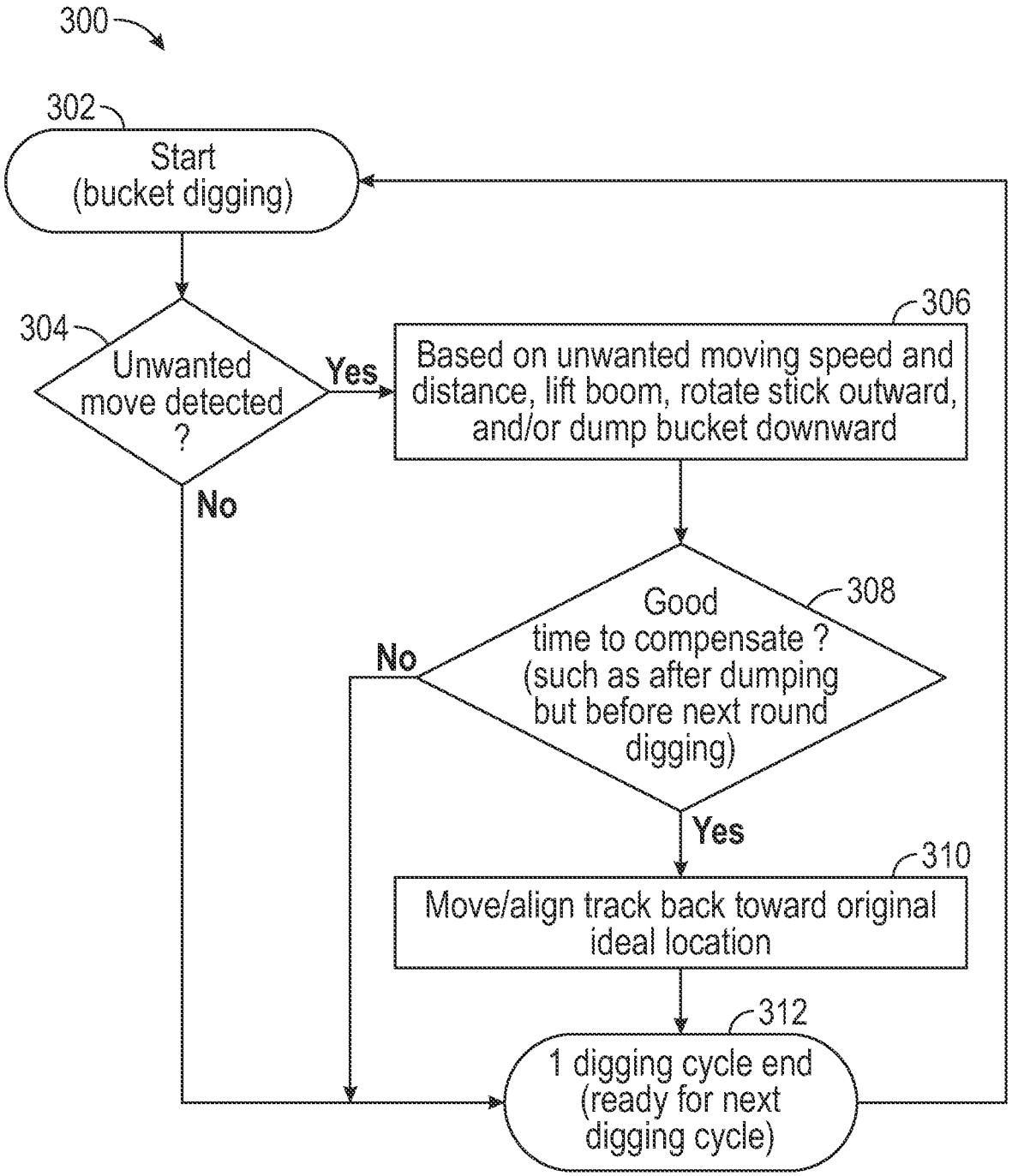
FIG. 3 shows a flow chart of a process for unintentional movement mitigation and compensation in accordance with this disclosure.

FIG. 3 shows a flow chart of a process 300 for unintentional movement mitigation and compensation in accordance with this disclosure. The process 300 can be performed by processing circuitry, for example, of the controller 150 or the remote device 154, although embodiments are not limited thereto.

The process 300 begins with operation 302 with beginning of a work machine 100 operation, for example, commencement of digging for excavators and other work machines 100 that can perform digging (e.g., backhoes, mini-excavators, mining shovels, electric rope shovels, wheel loaders, etc.). Generally, when a digging cycle starts (e.g., when bucket 118 starts digging), at operation 304, the processing circuitry can perform mitigation to detect or determine a probability that unwanted work machine 100 movement may occur at operation 304. Such detection could be based on reaction force from the bucket 118, track 112 or work machine 100 movement distance, track 112 or work machine 100 moving speed (based on IMU and/or GPS). Other indicators can apply to other types of work machine 100. For example, the hydraulic pressure signal(s) of the boom 114 can be monitored, stick 116 or bucket 118 hydraulic cylinders (usually head-end) can be monitored and, upon indicating a threshold force, mitigation actions can be undertaken.

At operation 306, if unwanted movement or potential is detected, the processing circuitry can perform mitigation operations similarly to those described above. For example, the processing circuitry can control the boom 114 to lift, or the bucket 118 to dump downward, and/or to move the stick 116 outward, serially, simultaneously, or in any combination thereof. Mitigation operations can be provided to reduce horizontal dirt interaction and downward pitching cab movement, thus reduce reaction force.

Even after the processing circuitry provides mitigation control signals, and even after mitigation operations are performed by the work machine 100, the work machine 100 can still move several inches or even feet. As described above, this can adversely affect digging operations, particularly when an operator is not present to prevent such movement. Accordingly, the processing circuitry can determine whether the unwanted movement is large enough to move the work machine 100 outside a threshold range of the original or desired digging location. The threshold range can be defined as, for example, a circular or ellipsoid threshold to the machine center-of-rotation pose, or as a square or rectangular threshold (in directions fore-aft vs side-to-side). Other thresholds may be considered including those that reference machine pitch and roll angles. If the unwanted movement is large enough, at operation 308, the processing circuitry can choose a time instant at which to perform compensation or to begin performing compensation, and further select a compensation action.

Although configurable for different excavation phases, compensation actions can be particularly beneficial during an excavator "swing back" phase (after dumping but before next dig cycle because performing compensation at "swing back" can minimize the effects of compensation on active digging or dumping. In any case, once the best compensation time has been determined, at operation 310, the processing circuitry can apply track commands to left/right tracks, once a navigation planner has been executed to determine the best navigation path to use, to move toward original ideal location (e.g., the work machine 100 location before the unwanted movements occurred). At operation 312, digging can occur or resume.

In an example, the compensation movement should be as smooth as possible, thus the movement command should have a minimal effect needed to move the work machine 100 back to the original location. In some examples, the amount of time for swing back can be predicted, and movement controlled at a speed to move the work machine 100 back within that swing back time. For example, if swing back time is around 3 seconds, and machine maximum track speed is 2 m/s, and the unwanted movement distance is 3 meters, then the processing circuitry can apply half the maximally possible track speed to correct (or compensate) for the unwanted movement. Compensation movement is therefore kept to a minimum speed to provide smooth work machine operation.

On the other hand, if the unwanted movement distance is 7 meters, then the processing circuitry can apply the maximally possible track speed to compensate. In this example, the remaining 1 meter can either be covered by an additional bucket pause before digging to allow time for additional chassis compensation, or additional compensation can be provided in a next subsequent dig cycle. If compensation is still needed in a subsequent digging cycle, the processing circuitry can perform mitigation similar to operation 306, or perform compensation similar to operation 310, or a combination of both mitigation and compensation.

By performing mitigation and compensation as described herein, processing circuitry according to example aspects can avoid deleterious effects of unwanted movement on digging and dumping performance of work machines. Operators can also avoid relentless empty bucket digging which could be caused by digging location errors.

INDUSTRIAL APPLICABILITY

In general, work machine 100 can be configured and equipped to detect actual or impending unwanted movement that places the work machine 100 away from an original location and away from a location at which the work machine 100 is meant to perform digging operations. The work machine 100 can include sensors to detect horizontal machine movement and to provide mitigation control signals if there is a high probability that unwanted machine movement will occur. This probability can be determined based on terrain around the work machine 100, speed of the work machine 100, reaction force as sensed by other sensors of the work machine 100, and other factors. If mitigation measures are insufficient to prevent unwanted movement, then compensatory movements can be controlled to move the work machine 100 back to the work machine 100 original or ideal position for digging or other work. Compensatory movement can be undertaken at such times and at such speeds that jerky movements are avoided and that digging operations are not affected.

The above detailed description is intended to be illustrative, and not restrictive. The scope of the disclosure should, therefore, be determined with references to the appended claims, along with the full scope of equivalents to which such claims are entitled.

What is claimed is:

1. An excavator that mitigates and compensates for movement due to digging, the excavator comprising:

a lower structure comprising a pair of tracks;

an upper structure arranged on the lower structure;

a working element comprising a boom mounted on the upper structure at a pivot point, a stick pivotably coupled to the boom, and a bucket pivotably coupled to the stick;

sensor circuitry configured for sensing movement information of the excavator including horizontal movement of the excavator across a supporting surface; and processing circuitry coupled to the sensor circuitry to receive the movement information of the excavator and configured for:

performing a digging task with the working element, where performing the digging task causes the horizontal movement of the excavator;

during performing the digging task, mitigating the horizontal movement of the excavator;

after mitigating the horizontal movement, comparing the horizontal movement of the excavator to a threshold;

dumping the bucket; and after dumping the bucket, after comparing the horizontal movement of the excavator to a threshold, and where, despite mitigating the horizontal movement of the excavator, the horizontal movement of the excavator exceeds the threshold, compensating for the horizontal movement of the excavator by using the tracks to move the excavator horizontally.

2. The excavator of claim 1, wherein mitigating comprises lifting the boom.

3. The excavator of claim 1, wherein mitigating comprises performing a stick out operation.

4. The excavator of claim 1, wherein compensating for movement of the excavator comprises moving tracks forward or backward.

5. The excavator of claim 1, wherein compensating for movement of the excavator is performed before a next digging task.

6. The excavator of claim 5, wherein after dumping the bucket and before a next digging task defines a swing back time and compensating for movement of the excavator is performed at a minimum speed required to compensate for the movement of the excavator during the swing back time.

* * * * *